US007159746B2

(12) United States Patent
Duff

(10) Patent No.: US 7,159,746 B2
(45) Date of Patent: Jan. 9, 2007

(54) STAPLE-FORMING APPARATUS

(76) Inventor: William G. Duff, 9516 SE. Keystone Dr., Lee's Summit, MO (US) 64086

( * ) Notice: Subject to any disclaimer, the term of this patent is extended or adjusted under 35 U.S.C. 154(b) by 0 days.

(21) Appl. No.: 10/951,341

(22) Filed: Sep. 27, 2004

(65) Prior Publication Data

US 2005/0067455 A1 Mar. 31, 2005

Related U.S. Application Data

(60) Provisional application No. 60/506,630, filed on Sep. 26, 2003.

(51) Int. Cl.
*B25C 5/08* (2006.01)

(52) U.S. Cl. ..... 227/86; 227/82; 227/87; 227/92; 227/120

(58) Field of Classification Search ..... 227/82, 227/86, 87, 92, 120; 270/52.18, 58.08, 58.09, 270/52.08

See application file for complete search history.

(56) References Cited

U.S. PATENT DOCUMENTS

| | | | | | |
|---|---|---|---|---|---|
| 3,751,961 | A * | 8/1973 | Graf | 72/339 |
| 4,318,555 | A * | 3/1982 | Adamski et al. | 227/7 |
| 4,389,011 | A * | 6/1983 | Lovibond | 227/5 |
| 4,444,347 | A * | 4/1984 | Males | 227/88 |
| 4,512,506 | A | 4/1985 | Fischer | |
| 4,546,910 | A * | 10/1985 | Logtens | 227/155 |
| 4,573,625 | A * | 3/1986 | Olesen et al. | 227/131 |
| 4,747,531 | A * | 5/1988 | Brinkerhoff et al. | 227/19 |
| 4,874,122 | A * | 10/1989 | Froelich et al. | 227/19 |
| 5,018,656 | A * | 5/1991 | Phelps | 227/84 |
| 5,113,732 | A * | 5/1992 | Hansch | 83/154 |
| 6,119,911 | A * | 9/2000 | Funk et al. | 227/88 |
| 6,193,126 | B1 * | 2/2001 | Lee | 227/83 |
| 6,308,951 | B1 | 10/2001 | Allmendinger et al. | |
| 6,378,197 | B1 * | 4/2002 | Hansen | 29/823 |
| 6,547,230 | B1 * | 4/2003 | Sato | 270/58.08 |
| 6,554,172 | B1 * | 4/2003 | Hohner et al. | 227/82 |
| 6,641,129 | B1 * | 11/2003 | Ogita et al. | 270/58.08 |
| 6,772,930 | B1 * | 8/2004 | Ayres | 227/83 |
| 6,773,004 | B1 | 8/2004 | Obregon et al. | |
| 7,032,898 | B1 * | 4/2006 | Silberbauer | 270/52.18 |
| 2004/0232194 | A1 * | 11/2004 | Pedicini et al. | 227/131 |

FOREIGN PATENT DOCUMENTS

| | | |
|---|---|---|
| DE | 44 44 220 | 7/1995 |

* cited by examiner

*Primary Examiner*—Scott A. Smith
*Assistant Examiner*—Gloria R. Weeks
(74) *Attorney, Agent, or Firm*—Shughart Thomson & Kilroy, PC; Richard P. Stitt

(57) ABSTRACT

A staple-forming and inserting apparatus 10 is provided having an apparatus 22 for movement of the cutter box 20 to allow automatic variations in staple length for one or more staple-forming and inserting apparatus 10 said staple-forming and inserting apparatus 10 being provided with a staple crown 105 supporting shoe 56 to permit supported insertion of the staple into the workpiece the device 10 having blades 50*a*, 50*b* for pinch-cutting of the staple wire 72 to provide chisel ends to legs 101 of stable 100 device 10 have key and rail construction to allow the operating drive 16 and bender 18 rails to travel on keys 32 that may be replaced to avoid wear on drive 16 and bender 18 rails and replacement of the rails and a floating bender rail 18 that prevents overstrike and damage to knives 50*a*, 50*b*.

3 Claims, 18 Drawing Sheets

STAPLE-FORMING APPARATUS

PRIORITY DATA

This application claims priority to U.S. Provisional Patent Application Ser. No. 60/506,630 filed Sep. 26, 2003.

FIELD OF THE INVENTION

This invention relates to the field of automatic stapling devices, specifically devices which form staples and immediately insert the staple into the workpiece or material to be secured together. The present invention provides for a stapler housing which provides operating assemblies on key tracks within the housing and which provides for continued support of the staple during the insertion step as well as automatic adjustability and automatic centering of a selected staple wire length on the staple forming jig during the stapling process

DESCRIPTION OF THE RELATED ART

In order to staple material such as paper, cardboard or the like, use is made, according to the prior art (DE 44 44 220), in stapling machines of so-called stapling heads which, in addition to other components, have staple-forming apparatuses. In these stapling apparatuses, which are also referred to as staple forming means, a cut-to-length piece of wire is bent into a u-shaped staple before being driven, by means of a staple driver, into the paper stack which is to be stapled.

The staple driver in this case is usually fitted in a moveable manner on a pusher in a forming-means housing. In order to form the staple, the forming-means housing has two side guides, in each of which is provided a groove for guiding the wire. The two end legs of the staple are formed in said side guides. The pusher itself comprises a driver which is positioned thereon and has an accommodating groove in a direction transverse to the movement direction so that the crosspiece of the staple or crown is formed between the two end legs. The entire forming means is actuated via a drive acting on the pusher.

SUMMARY OF THE INVENTION

The invention is comprised of two major components which work in tandem to form and insert a staple into material to be stapled together. The first component is the staple forming and insertion device 10, and the second component is the wire advancing unit.

Figure 3C:
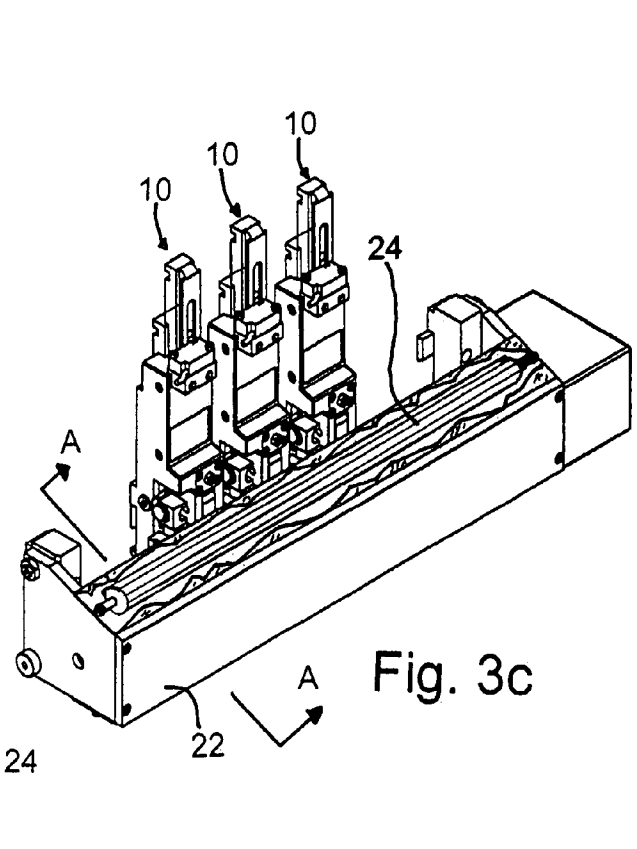
FIG. 3*c* is a top perspective view of a gang of three stapling forming and insertion devices 10 engaged with a single cutter box adjustment unit 22 and showing the top surface of the cutter box adjustment unit in fragmentary view to reveal the spline gear 24 seated within.
Figure 3B:
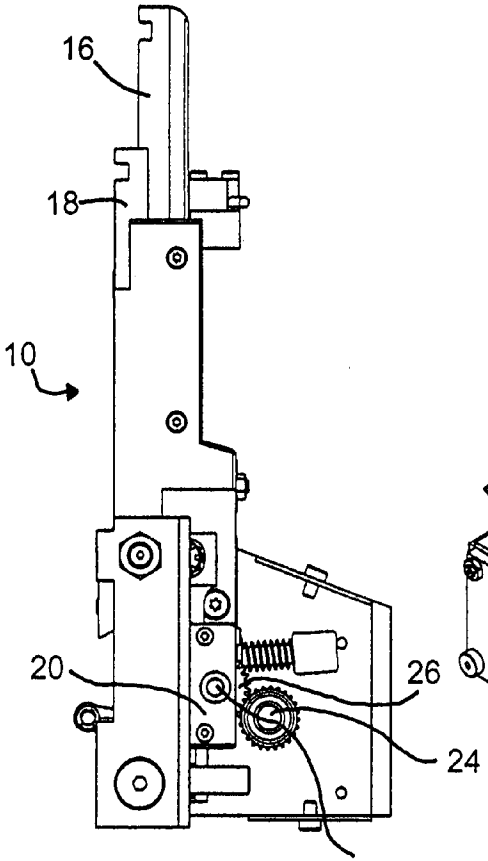
FIG. 3*b* is a left side elevation view of the assembled staple forming and insertion device with the cutter box adjustment unit 22 shown in cross-section view taken along line A—A of FIG. 3*c* with the cutter box adjustment unit in the engaged position and showing the spline gear 24 of the adjustment unit registered with the adjustment wheel 26 of the cutter box 20.
Figure 3A:
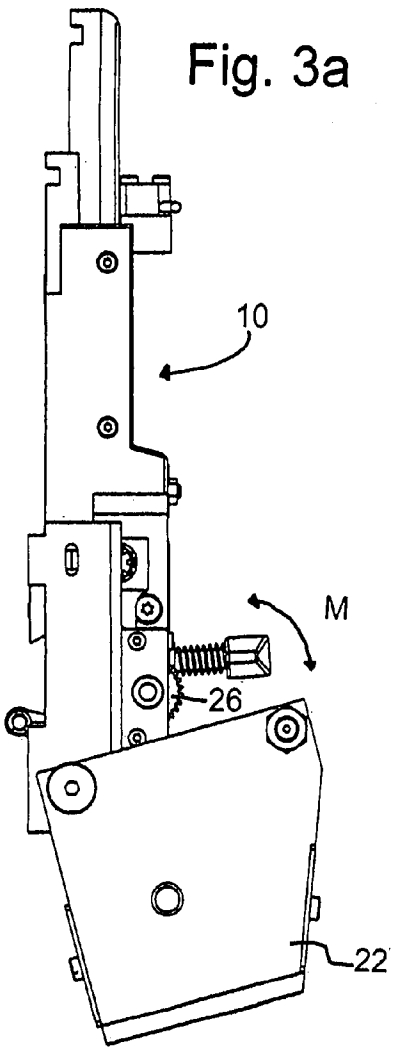
FIG. 3*a* is a left side elevation view of the staple forming and insertion device having the cutter box adjustment unit attached thereto and the cutter box 20 shown rotated downwardly in the maintenance position.

The staple forming and insertion unit is shown in FIGS. 3A–C where it is connected to cutter box adjustment unit 22 which permits lateral movement and adjustment of a cutter box 20 of a staple forming and insertion device to accomplish centering of a cut length of staple wire within the staple forming portion of the staple forming and insertion device 10.

It will be appreciated that the present invention allows automatic adjustment of the position of the wire within the staple forming and insertion unit to permit the selection and use of a new staple leg length to accommodate a new thickness of material to be stapled. This is accomplished while avoiding manual adjustment of cutter box 20 to center the newly selected staple wire length within the staple forming portion of the staple forming and insertion unit. The present invention also provides for pinch-cutting of the staple wire rather than shear-cutting of the staple wire thereby providing a staple having a chisel point in contrast to the flat or blunt end provided by the shear cutting of the wire in prior art in automatic staple forming units.

In addition to automatically adjusting for a new overall wire length and centering the newly selected wire length within the staple forming portion of the device to provide generally equal legs to the new staple length, the present invention allows for full automation of the spacing apart of the staple forming and insertion unit heads in conjunction with the automatic selection of a new staple length and the automatic centering of the newly selected length of staple wire with respect to the staple forming and insertion unit. The prior art units merely permitted automatic repositioning of the spacing between staple forming and insertion heads through the use of shaft encoder technology followed by manual adjustment of the cutter box to center the newly selected wire length on the forming apparatus to provide even length staple legs.

Figure 1A:
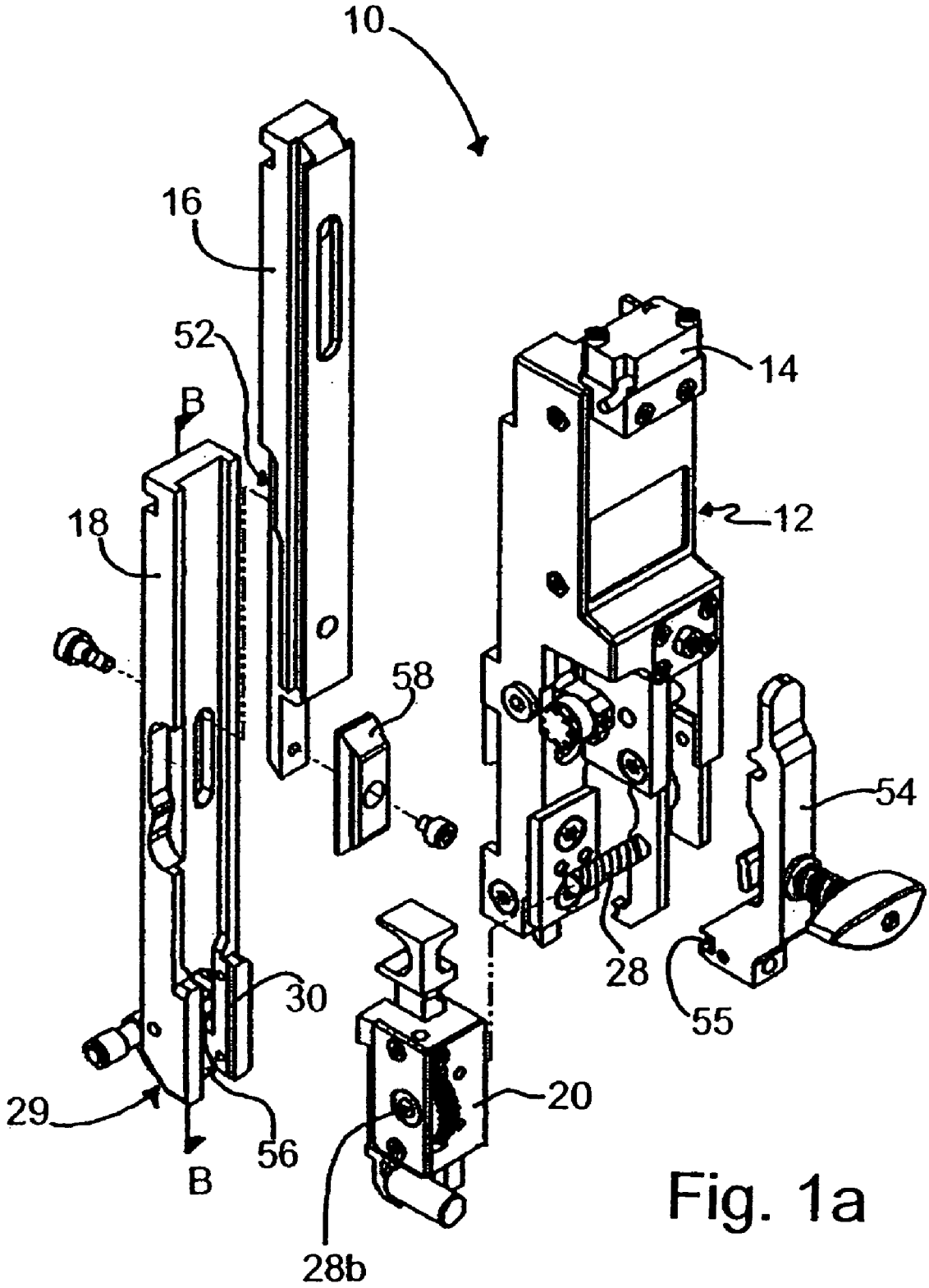
FIG. 1*a* is an exploded view of the device which is shown assembled in FIG. 3*d;*
Figure 1B:
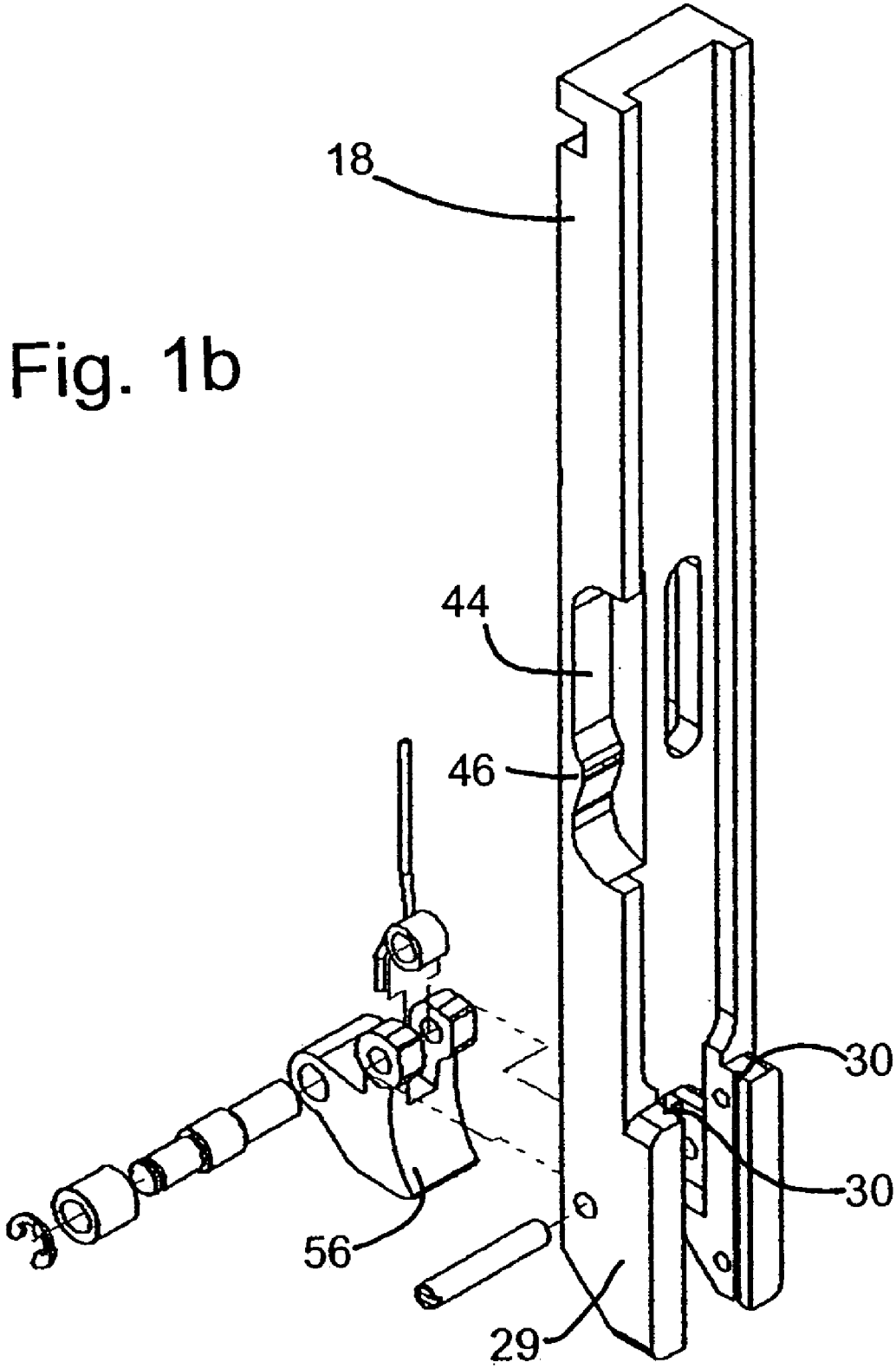
FIG. 1*b* is an exploded front and left side perspective view of the bender rail shown assembled in FIG. 1*a;*

The present invention further allows the bender rail of the forming device to "float" or to move outwardly from the body of the device through the use of spring washers or a "belleville washer" 19 (FIG. 1*f*) to thereby reduce the pressure on the knives if the knife stroke is not properly adjusted thereby reducing wear on the knives and need for replacement of the knives.

A belleville washer 19 is also known as a cupped spring washer, and is a type of non-flat washer having a slight conical shape which gives the washer a spring characteristic. A similar device is a wave washer. Belleville washers are typically used as springs or to apply a pre-load or flexible quality to a bolted joint. Multiple Belleville washers may be stacked to modify the spring constant or amount of deflection. Stacking in the same direction will add the spring constant in parallel, creating a stiffer joint (with the same deflection). Stacking in an alternating direction is the same as adding springs in series, resulting in a lower spring constant and greater deflection. Mixing and matching directions allow a specific spring constant and deflection capacity to be designed.

The present invention further provides for a beneficial reduction of the number of movable parts which ride on the frame or body of the device by utilizing keys or rails 40 mounted on the body for support of moving parts of the staple forming an insertion unit thereby reducing the repair costs of the device by avoiding wear on the body of the device and allowing for substitution of the mounting rails or keys 40 or the part moving on the support rails or keys rather than replacement of the entire staple forming and insertion unit.

The present invention further provides for a knife support shoulder which prevents the opposed knife edges from being pushed past one another as a result of misadjustment of the knife stroke and which operates in combination with the "floating" aspect of the bender rail to reduce wear and damage to the cutter knives.

The invention further comprises a staple forming and cutter head device having a shoe or shoe tongue comprising a radius surface thereon which allows support of the crown of the staple during the insertion of the staple into the work piece thereby permitting a reduction in the gauge of wire that is selected for use in stapling the work piece thereby resulting in a substantial cost savings through use of the present invention.

The present invention further comprises a stop on the shoe or shoe tongue which avoids overextending of the shoe tongue in its rearward movement thus contributing to breakage of the spring biasing of the shoe tongue in the prior art devices. In one embodiment of the present invention, the stop attached to the shoe or shoe tongue impacts the bender rail of the present invention and prevents overextention rearwardly of the shoe tongue.

The present invention further comprises the use of a wedge mounting plate for the cutter box which alleviates binding of the cutter box on the mounting plate during the downward stroke of the cutter knives thereby permitting repositioning of the cutter box during operation of the stitching head or staple forming and insertion unit to permit automatic adjustment of the cutter box during the process of selection of a new staple leg length and the centering of the new wire length with respect to the staple forming apparatus.

Wire Selection and Advancing Unit

The present invention also comprises a wire advancing and length selection drive which permits selection of new wire lengths for feeding to a stitching head or staple forming and insertion unit. The new design is compact and allows for air cooling of the device by air vents or vanes which utilize the rotating motion of the wire advancing drive and stapling unit to direct air toward the stepper motor to cool the motor and adjacent circuit board during its operation to advance the wire through the device.

The wire advancing drive device comprises, generally, a central driving shaft operated by the stepper motor upon which gears associated with grooved wire advancing drums or cylinders are mounted. The drums are compressible against an opposed set of wire advancing drums to provide frictional capture of the wire therebetween thus providing secure and accurate advancement of the wire in indexed or incremental fashion.

The invention further comprises individual engagement and stop keys which govern the compression of the drums or cylinders against one another to initiate or terminate wire advancement on an individual wire strand to thereby permit refeeding of a single wire strand through the wire advancing device. The compact design of the inventive wire advancement device permits mounting of the wire advancement device directly adjacent to the stitching head or staple forming and insertion unit. The wire advancing unit further comprises a wire exit alignment unit which is spring biased in position and permits movement of the guide away from the body of the wire advancement unit for ease of insertion of new wire through the device. The wire advancing drive further comprises beveled wire guide plates adjacent to the drums or wheels which compressively capture the wire therebetween thereby permitting self feeding of a new wire strand through the wire advancing drive.

DETAILED DESCRIPTION

Figure 1C:
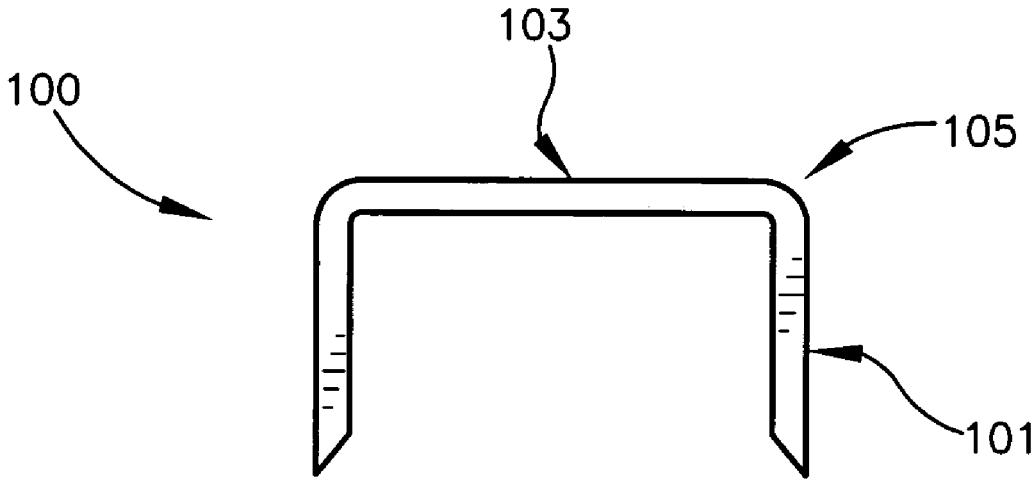
FIG. 1*c* is a front elevation view of a staple showing the parts of a typical staple.
Figure 1D:
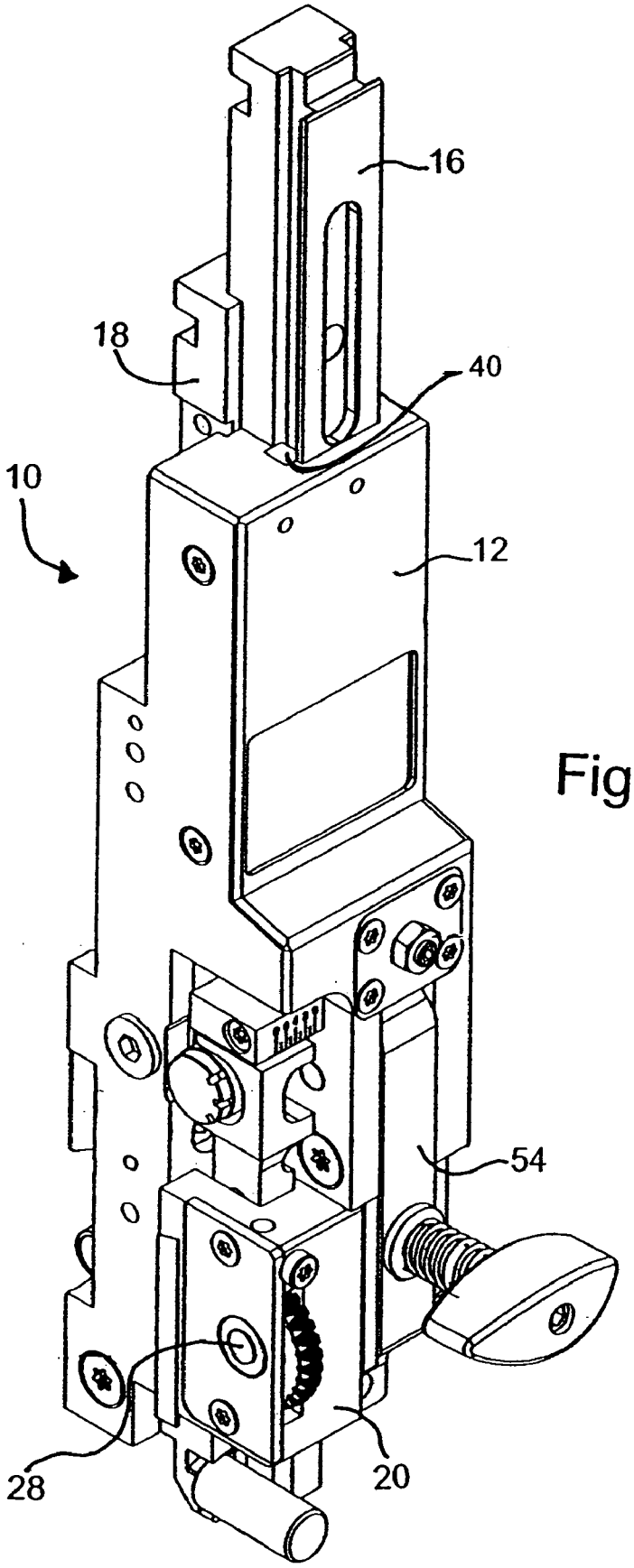
FIG. 1*d* is a front and left side elevation assembled view of the staple device of FIG. 1*a;*
Figure 1E:
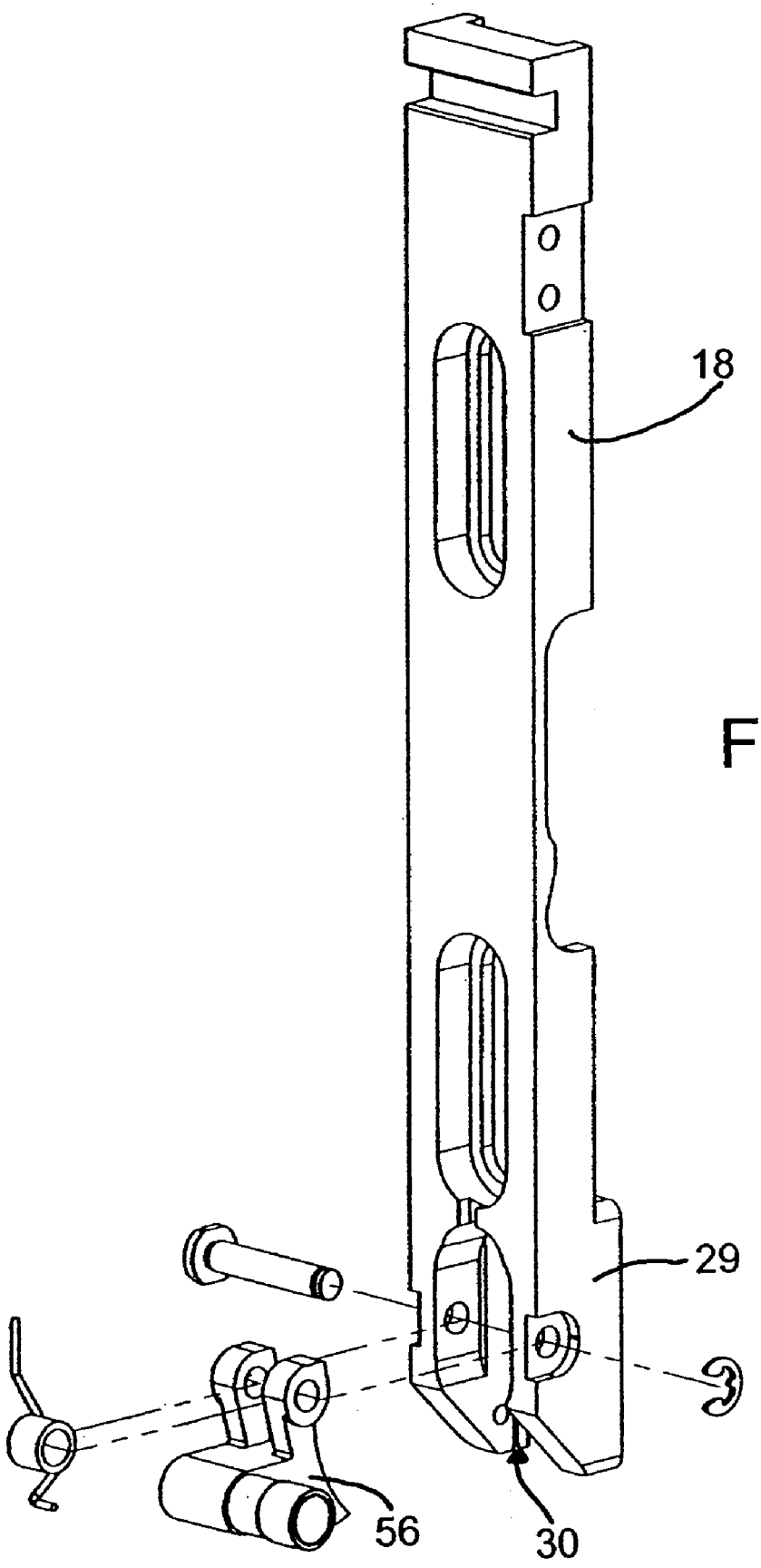
FIG. 1*e* is an exploded rear and left side perspective view of the bender rail shown assembled in FIG. 1*a;*
Figure 1F:
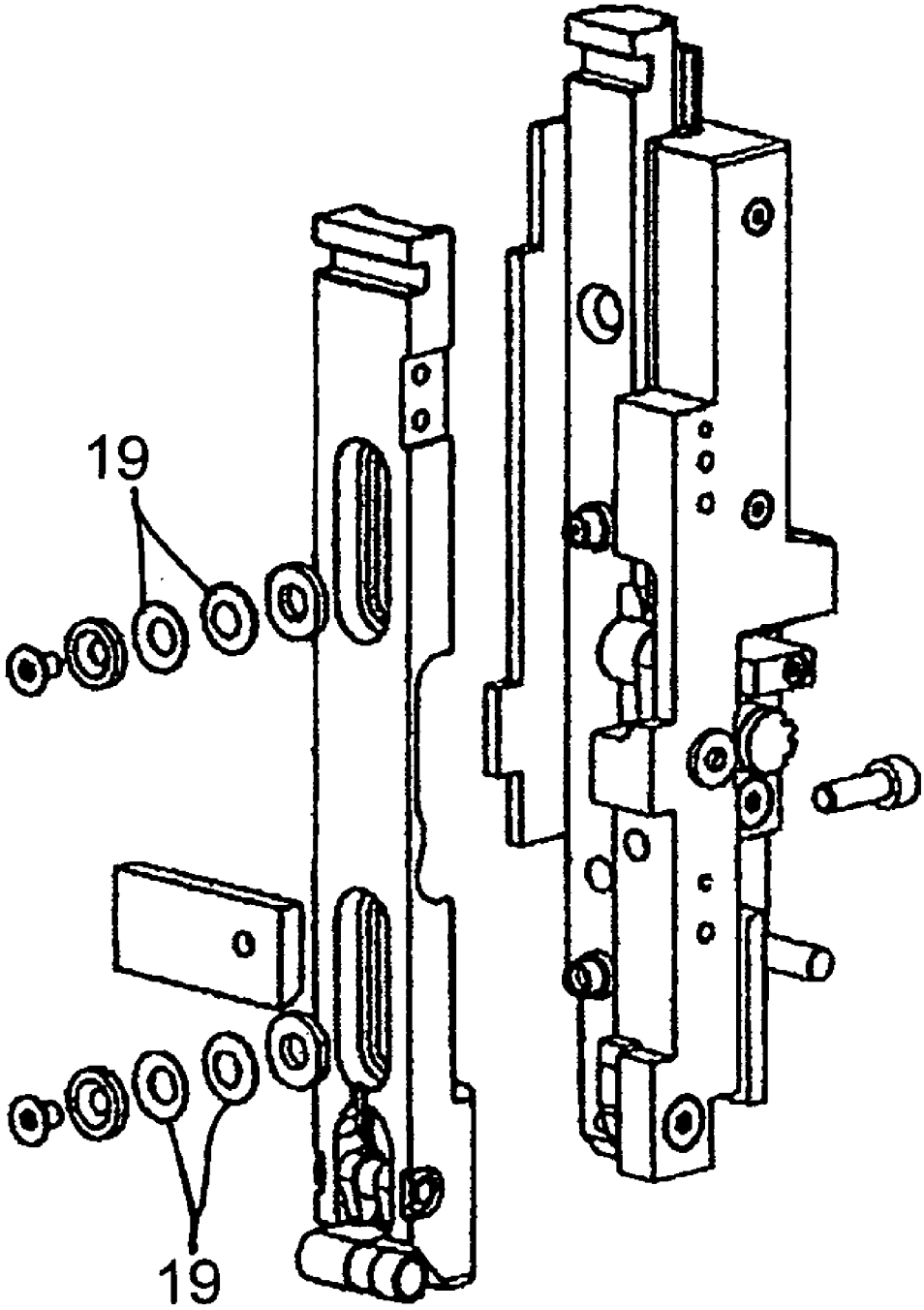
FIG. 1*f* is an exploded rear and left side perspective view of the bender rail and driver rail shown in FIG. 1*a* and showing the location of the belleville washers 19.
Figure 3D:
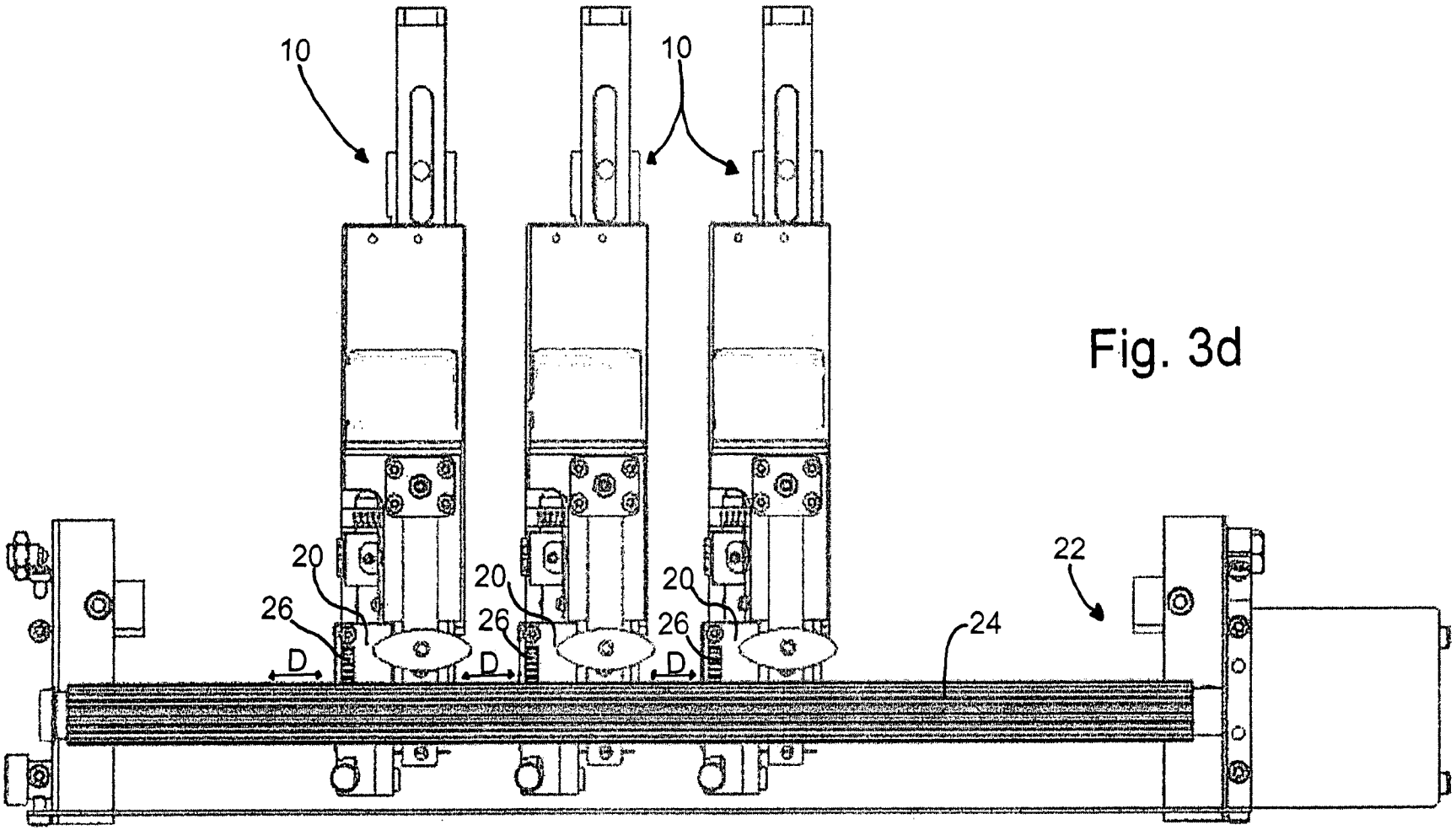
FIG. 3*d* is a front elevation view of FIG. 3*c* with the case of the cutter box adjustment unit removed to show the positioning of spline gear 24 against adjustment wheel 26 of cutter box 20.

First referring to FIG. 3*c* and 3*d*, three staple forming and insertion devices 10 are shown gang mounted as would be the case on a gathering and stapling unit of a printing operation. Devices 10 are engaged with cutter box adjustment unit 22 which, in the present invention, operates to properly space cutter box 20 (FIG. 3*b*) of device 10 to permit proper positioning of a length of wire within cutter box 20 device 10 to allow formation of equal leg lengths 101 of a typical staple 100 (FIG. 1*c*).

The adjustment of cutter box 20 by cutter box adjustment unit 22 functions in the following manner: Cutter box adjustment unit 22 contains a spline gear 24 which engages with or registers with cutter box adjustment wheel 26 of cutter box 20. Cutter box adjustment wheel 26 is provided with a central threaded void 28*b* (FIG. 1*a*) for mounting of the wheel 26 on threaded post 28 (FIG. 1*a*). Adjustment of the position of cutter box 20 along the length of cutter box threaded post 28 in the directions of arrows D (FIG. 3*d*) is accomplished by the rotation of cutter box adjustment wheel 26 which is urged into rotation by spline gear 24 of cutter box adjustment unit 22.

In this manner, when it is desired to change the length of the legs 101 of a staple 100 (FIG. 1*c*), a longer or shorter length of wire is released from the wire supply feeding cutter box 20 and a control unit signals cutter box adjustment unit 22 to rotate in the proper direction indicated by Arrow D (FIG. 3*d*) to adjust the position of cutter box 20 on cutter box threaded post 28. The movement of cutter box 20 on cutter box threaded post 28 shifts cutter box 20 in the directions indicated by Arrow D (FIG. 3*d*) to position cutter box 20 nearer to, or farther from, staple forming jig 29 (FIG. 1*a*) of bender rail 18 thereby allowing centering the length of wire that is cut by cutter box 20 with respect to staple forming jig 29 and wire guide grooves 30 (FIG. 1*a*) of staple forming jig 29. The result of this automatic movement caused by signals to cutter box adjustment unit 22 is to provide two generally equal length legs 101 on staple 100 (FIG. 1*c*). It will be appreciated by those skilled in the art that the signals to cutter box adjustment unit 22 are to be supplied from a controller that is provided with data regarding the thickness of the workpiece to be stapled. The controller then signals cutter box adjustment unit 22 the direction of rotation for spline gear 24 and the amount of rotation to extend or retract cutter box 20 along Arrow D (FIG. 3*d*) to properly position cutter box 20. In U.S. Pat. No. 4,318,555, the specification of which is incorporated herein by reference, a means for determining the number of sheets, or thickness, of a stack of workpieces is described and a logic and control means for incrementally advancing the wire for staple forming. Additional devices for determining the height of a stack of sheets may be found in U.S. Pat. Nos. 6,308,951 and 6,773,004 the specifications of which are incorporated herein by reference.

Referring now to FIGS. 3*a* and 3*b*, the movement of cutter box adjustment unit 22 in the directions indicated by Arrow M moves unit 22 between an open maintenance position shown in FIG. 3*a* and a closed operating position shown in FIG. 3*b*. In FIG. 3*b*, the engagement between spline gear 24 and cutter box adjustment wheel 26 for movement of cutter box adjustment wheel in response to movement of spline gear 24 is shown.

Figure 4D:
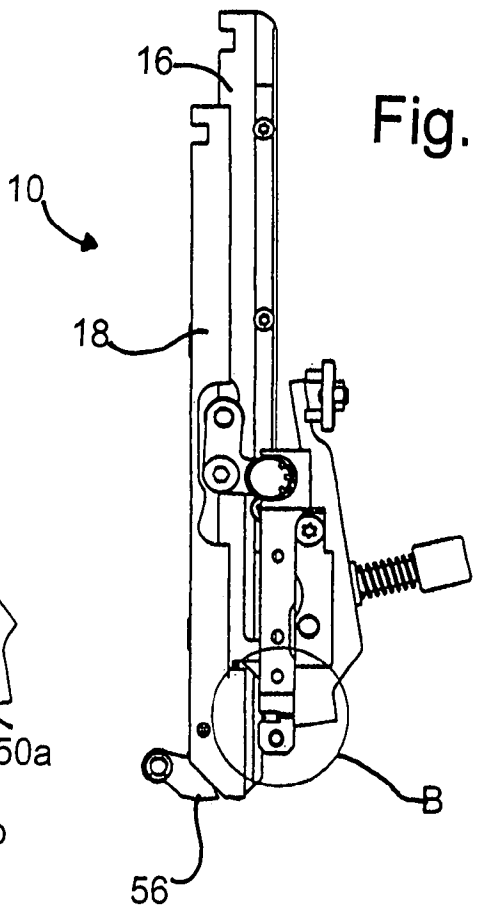
FIG. 4*d* is a side elevation view similar to that of FIG. 4*b* of the operating components of the staple forming an insertion device with the cutter box 20 (FIG. 1*d*) and the body 12 removed for clarity and showing the drive rail 16 in the downward position to drive a formed staple into a workpiece and the shoe 56 drawn rearward to allow the staple to supportably slide down the face of shoe 56 as the staple is driven into the workpiece and the former tool moved forward.
Figure 4C:
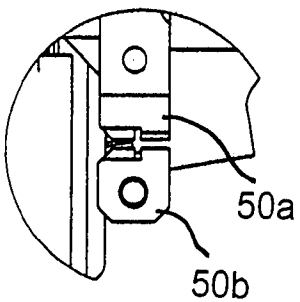
FIG. 4*c* is an enlarged portion of area B of FIG. 4*d* showing the pinch cut knives in open position.
Figure 4B:
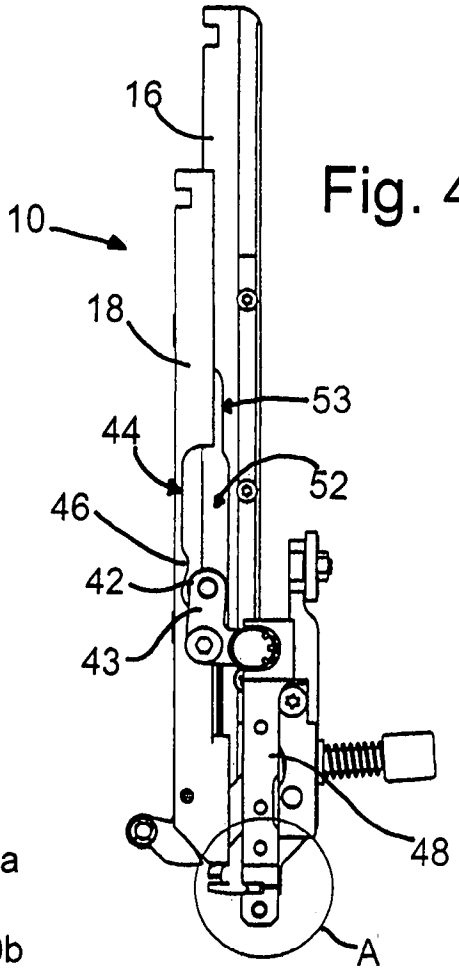
FIG. 4*b* is a side elevation view of the operating components of the staple forming an insertion device with the cutter box 20 (FIG. 1*d*) and the body 12 of the staple device removed for clarity.
Figure 4A:
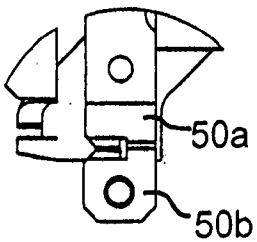
FIG. 4*a* is an enlarged view of Area A of FIG. 4*b* and showing the pinch-cut knives in closed position.
Figure 5:
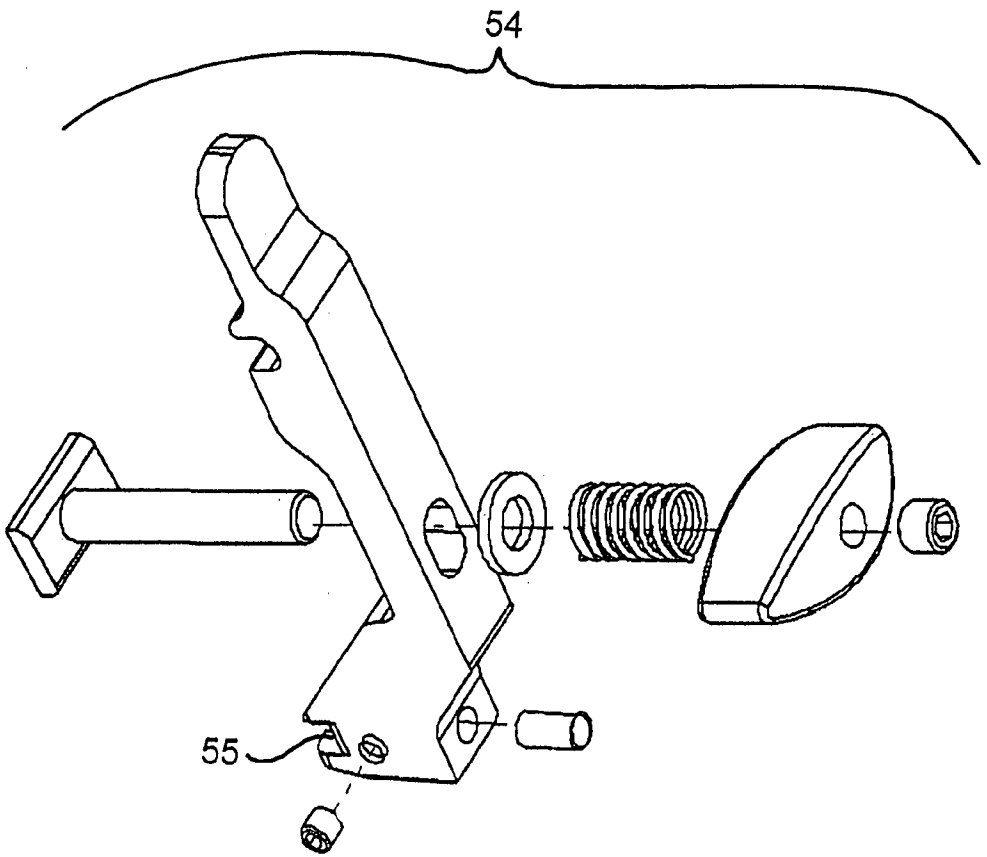
FIG. 5 is an exploded view of the former tool which is used to hold, orient and align the wire for forming into a staple by the bender rail.

Referring now to FIGS. 4*a*–*d*, the cutting stroke of the device 10 will be described. In FIG. 4*b*, the staple forming an insertion device 10 is shown in top dead center position of the machine timing which presents the knives 50*a*, 50*b* of cutter box 20 in closed position as is shown in FIG. 4*a*. This closed position of the knives serves to cut the wire into the desired length for the staple to be inserted corresponds to cam follower 42, mounted on follower arm 43, being in its lowest position along the length of cam 44. In achieving this lowered position shown in FIG. 4*b*, cam follower 42 will have passed over ridge 46 of cam 44 which actuates a downward stroke of shaft 48 and the closing of knives 50*a*, 50*b* (FIG. 4A) to cut the wire that is to be formed into a staple as it passes between knives 50*a*, 50*b*.

It will be appreciated by those skilled in the art that cam 44 is a reciprocating motion cam that is built into bender rail 18. Thus as bender rail 18 moves in its up and down stroke to form the legs 101 of the staple 100 (FIG. 1*c*), the cutting of the wire is properly timed to present a cut segment of wire to bender rail 18 for formation of the staple shoulders 105 and legs 101 (FIG. 1*c*) on the downward stroke of bender rail 18 as will be described hereinafter.

Figure 2:
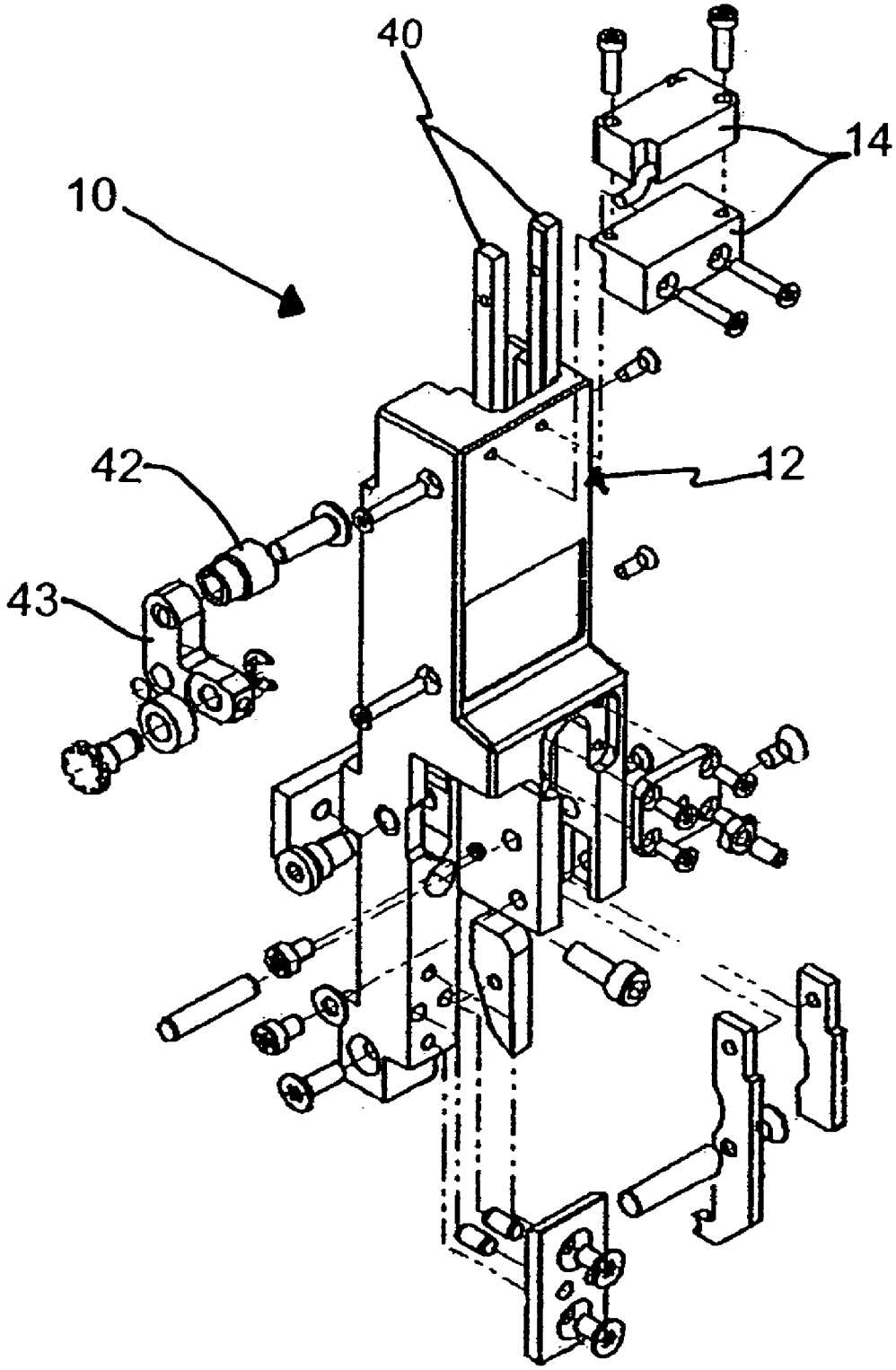
FIG. 2 is an exploded view of the body of the staple device which is shown assembled in FIG. 1*a;*

Referring now to FIGS. 4*c* and 4*d*, knives 50*a*, 50*b* are shown in their open position as a result of downward movement of bender rail 18 and driver rail 16. Drive rail 16 is provided with a cam 52 (FIG. 4*b*) which provides the repositioning of cam follower 42 to ensure the upward stroke of shaft 48 as cam follower contacts shoulder 53 of cam 52 on driver rail 16. Through this movement of cams provided on bender rail 18 and driver rail 16, shaft 48 exhibits reciprocating movement to move knife blades 50*a*, 50*b* to affect the cutting of the wire as it passes through cutter box 20. A proximity switch 14 (FIG. 1*a* and 2) is mounted on body 12 to detect the position of driver rail 16 when it is positioned upwardly and when it is positioned downwardly in its stroke.

As has been previously described, a length of wire is advanced through cutter box 20 by the operation of a wire feeding mechanism providing a length of wire to cutter box 20. The length of wire provided is then centered with respect to staple forming jig 29 by the movement of cutter box 20 with respect to staple forming jig 29 through the automatic movement of cutter box 20 by cutter box adjustment unit 22 in communication with adjustment wheel 26. Now with reference to FIGS. 1–6, the formation of the staple and insertion of the staple into a work piece will be described. Once the wire (not shown) has been advanced through cutter box 20, it is held in place by wire holding arm 54 which is provided with a magnetized head 55 to hold the wire piece in position with respect to wire forming jig 29, and in particular, with respect to wire guide grooves 30 within staple forming jig 29 of bender rail 18. A downward movement of bender rail 18 is then initiated and wire guide grooves 30 of bender rail 18 capture the wire piece therein and press the wire downwardly over shoe 56 to create staple shoulders 105 (FIG. 1*c*) and legs 101 of staple 100 with crown 103 of staple 100 supported across the face 60 of shoe 56. This action forms the shoulders 105 and legs 101 of the staple from the wire segment that has been cut by cutter box 20. This formation of the staple is then followed by a downward movement of driver rail 16 having insertion head 58 mounted thereon which engages staple crown 103 as it is positioned on face 60 of shoe 56 to drive the staple into the work piece.

Figure 6:
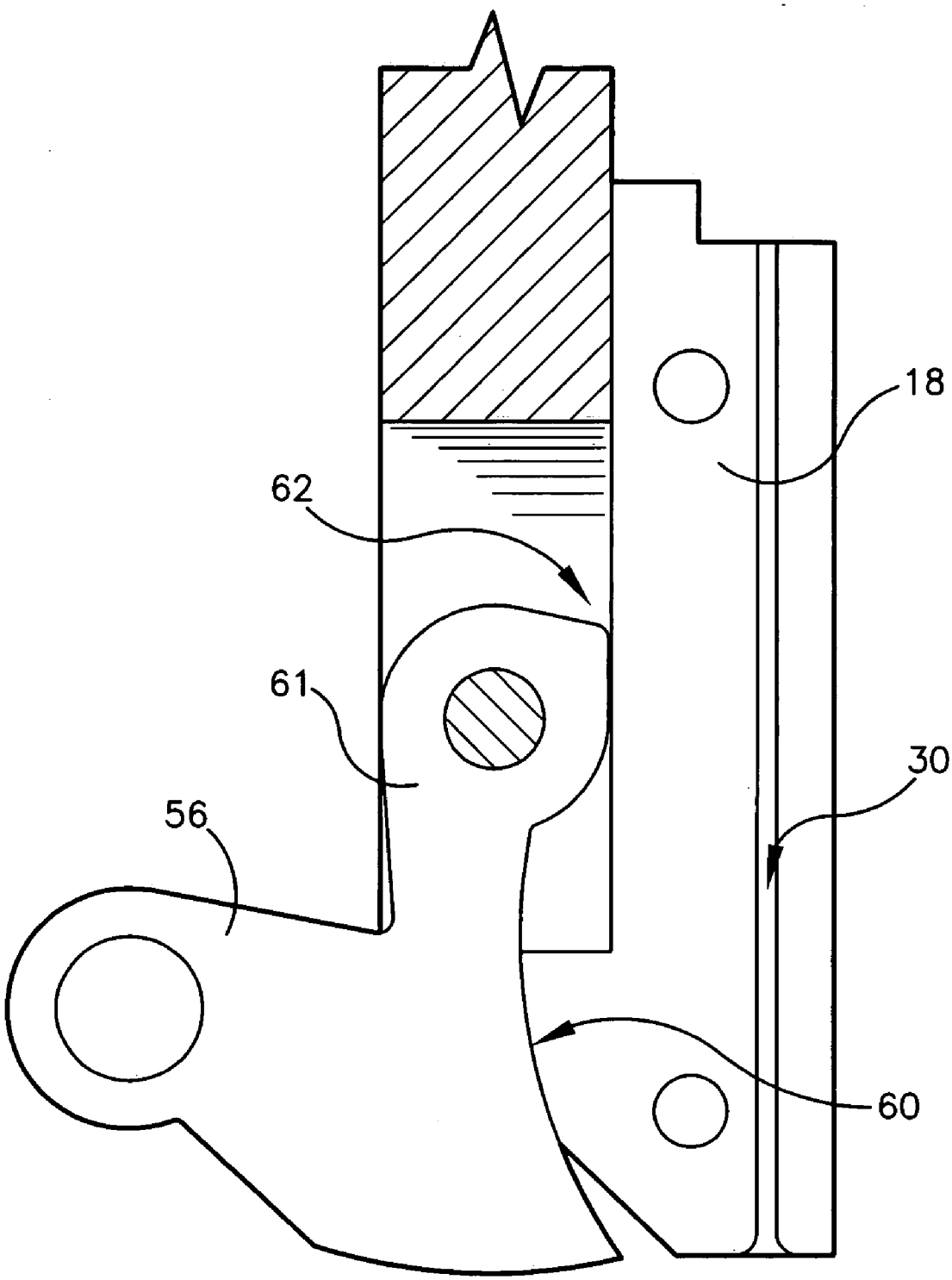
FIG. 6 is a cross-section view taken along line B—B of FIG. 1*a* of the shoe and tongue which is used to support the crown of the staple as it travels down wire guide groove 30 as staple insertion takes place.

Referring now to FIG. 6, a cross section view of shoe 56 taken along line B—B of FIG. 1*a* is shown. The orientation of the structure shown in cross section of FIG. 6 also may be appreciated by viewing the exploded view of the structure in FIG. 1*b*. Shoe 56 has a radius face 60 which engages staple crown 103 thereon. It will be appreciated by those skilled in the art that as insertion head 58 attached to driver rail 16 moves downwardly, it contacts face 60 of shoe 56 and staple crown 103, and as insertion head 58 is pressed downwardly by driver rail 16, shoe 56 which is spring biased in a position underneath wire guide grooves 30 is forced rearwardly by the downward movement of insertion head 58, while the radius face 60 of shoe 56 continues the support of crown 103 of staple 100 until insertion head 58 has finished the stroke caused by driver rail 16 and the staple is inserted into the work piece.

Shoe 56 is also provided with shoe tongue stop 62 on shoe tongue 61. During the travel of shoe 56 shoe tongue stop 62 contacts bender rail 18 to provide a positive stop to the rearward movement of shoe 56.

This constant support of staple crown 103 by radius face 60 of shoe 56 during the insertion stroke allows a thinner gauge of wire to be used during the stapling process as less staple strength is required to withstand the force placed upon the staple by insertion head 58 and the contact of the staple with the work piece. This reduction in the wire gauge that is necessary for forming an insertion of a staple within a work piece allows a significant savings to the user of the present invention. For example, each reduction in a gauge size provides 18 percent more wire per pound of metal used to form the wire. For example, it is typically necessary that a 24 to 25 gauge wire be used to form a staple for insertion through a quarter inch of paper product. With the present invention, 27 gauge wire can be used to form a staple that will be insertable within a quarter inch of paper material. Therefore with the present invention, a user may be able to use a gauge of wire for staples, which is one, two or three gauge sizes smaller than has previously been used resulting in 18 percent to 54 percent more wire length per pound of metal used to form the wire thus presenting a substantial reduction in cost to the operator.

Wire Incrementing and Advancing Device

Figure 7:
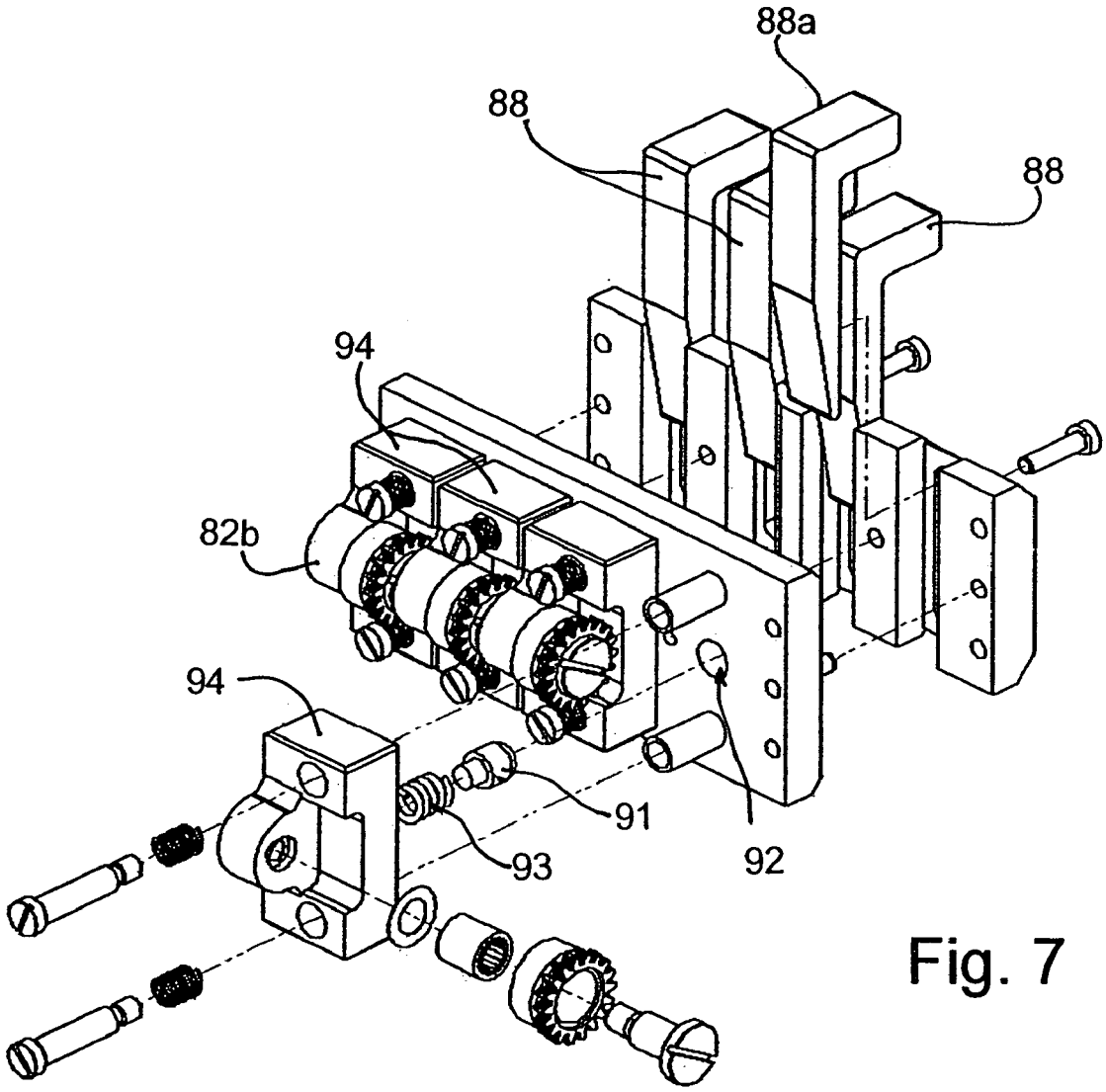
FIG. 7 is a rear and left side exploded view taken along line J—J of FIG. 8 of a portion of the wire capture mechanism or the wire advancing drive of FIG. 8 and showing the movable off-on pins 86 with three of the pins in the raised "off" position 86*a* which prevents frictional capture of the wire in the wire advancement drums.

Referring now to FIG. 7–13, the wire advancing drive 70 or wire incrementing and advancing device 70 of the present invention will be described. First referring to FIG. 8, wire incrementing and advancing device 70 is shown in partial exploded view. In general, the operation of wire incrementing and advancing device 70 is that a strand of wire 72 is fed to the device by first passing along entry wire guide 74 (FIG. 10) where it is received in feed tubes 76 after which it passes through cleaning pads 78 and into entry guide plate 80A. Referring to FIGS. 7 an 9, the wire is then captured between advancement drums 82*a* and 82*b* which are in operational, facing orientation in FIG. 8. Drums 82*a*, 82*b* capture wire 72 and drums 82*a*, 82*b* rotate to incrementally advance the wire in response to movement of motor 84. Again, it will be appreciated by those skilled in the art that the signals, similar to those supplied to cutter box adjustment unit 22, are provided to wire incrementing and advancing device 70. As is the case with cutter box adjustment unit 22, a controller is provided with data regarding the thickness of the workpiece to be stapled and the controller signals wire incrementing and advancing device 70 and advancement drums drive motor 83 which then causes the proper incremental rotation of advancement drums 82*a*, 82*b* to advance the desired length of wire 72 through advancement drums 82*a*, 82*b*. Wire 72 then passes through apertures 92 in guide plate 80*b* and into exit guide 84 (FIG. 12) and into exit guide tubes 86 for communication of the wire to cutter box 20 of staple forming and insertion device 10.

Figure 8:
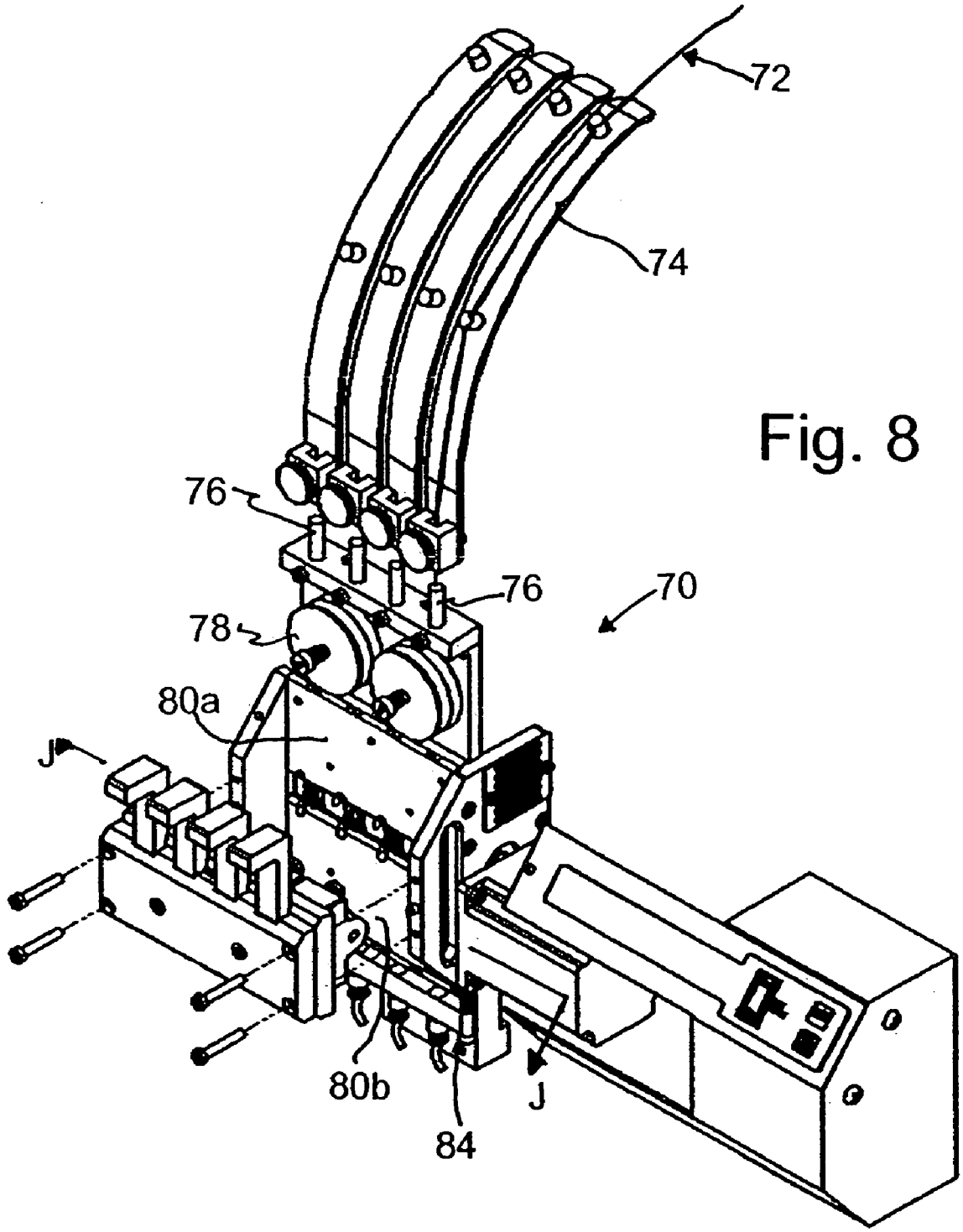
FIG. 8 shows the wire advancing drive or wire feed mechanism which receives multiple continuous strands of wire from bulk wire spools to allow for selection of specific wire lengths to be advanced by a stepper motor 84 (FIG. 9) into the staple forming and insertion device 10 of FIGS. 1–3*d* and showing the wire capture mechanism of FIG. 7 in position for coupling to the drive mechanism.

Referring now to FIG. 7 wherein a view taken along line J—J of FIG. 8 shows wire advancement drums 82*b*. Advancement drums 82*b* engage with wire advancement drums 82*a* (FIGS. 8 and 9) for frictional capture of wire 72 therebetween. In FIG. 7, advancement drum compression keys 88 are shown adjacent to wire advancement drums 82*b*. Keys 88 may be withdrawn or inserted to effect the compression of advancement drums 82*b* against advancement drums 82*a* to frictionally capture wire 72 therebetween for advancement as motor 83 rotates shaft 90 upon which drums 82*a,b* are mounted. When a key 88 is in the down position the advancement drum 82*b* associated with the key is urged against the corresponding advancement drum 82*a* to provide a frictional grip of wire 72 as it passes between advancement drums 82*a*, 82*b*. When a key 88 is in the down position the key provides resistance for spring support pin 91 which resides in void 92. The resistance provided by key 88 allows contact pressure spring 93 to urge drum block 94 holding advancement drum 82*b* therein toward advancement drum 82*a*. When key 88 is in the up position, no resistance is provided by key 88 to support spring support pin 91 and the urging of spring 93 is overcome by relief springs 95*a, b* which urges drum block 94 holding advancement drum 82*b* therein away from advancement drum 82*a*.

Figure 9:
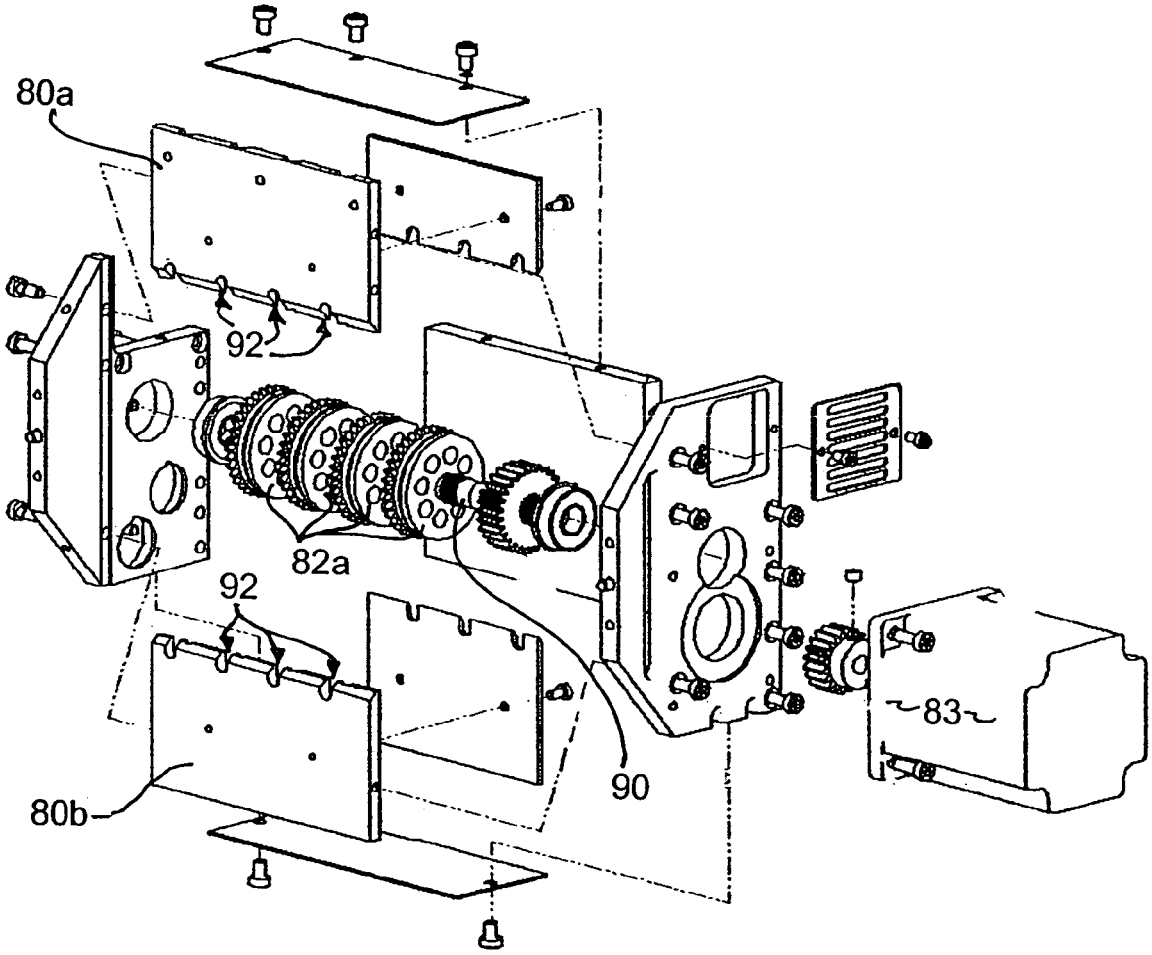
FIG. 9 shows the wire advancing drive in exploded view.
Figure 10:
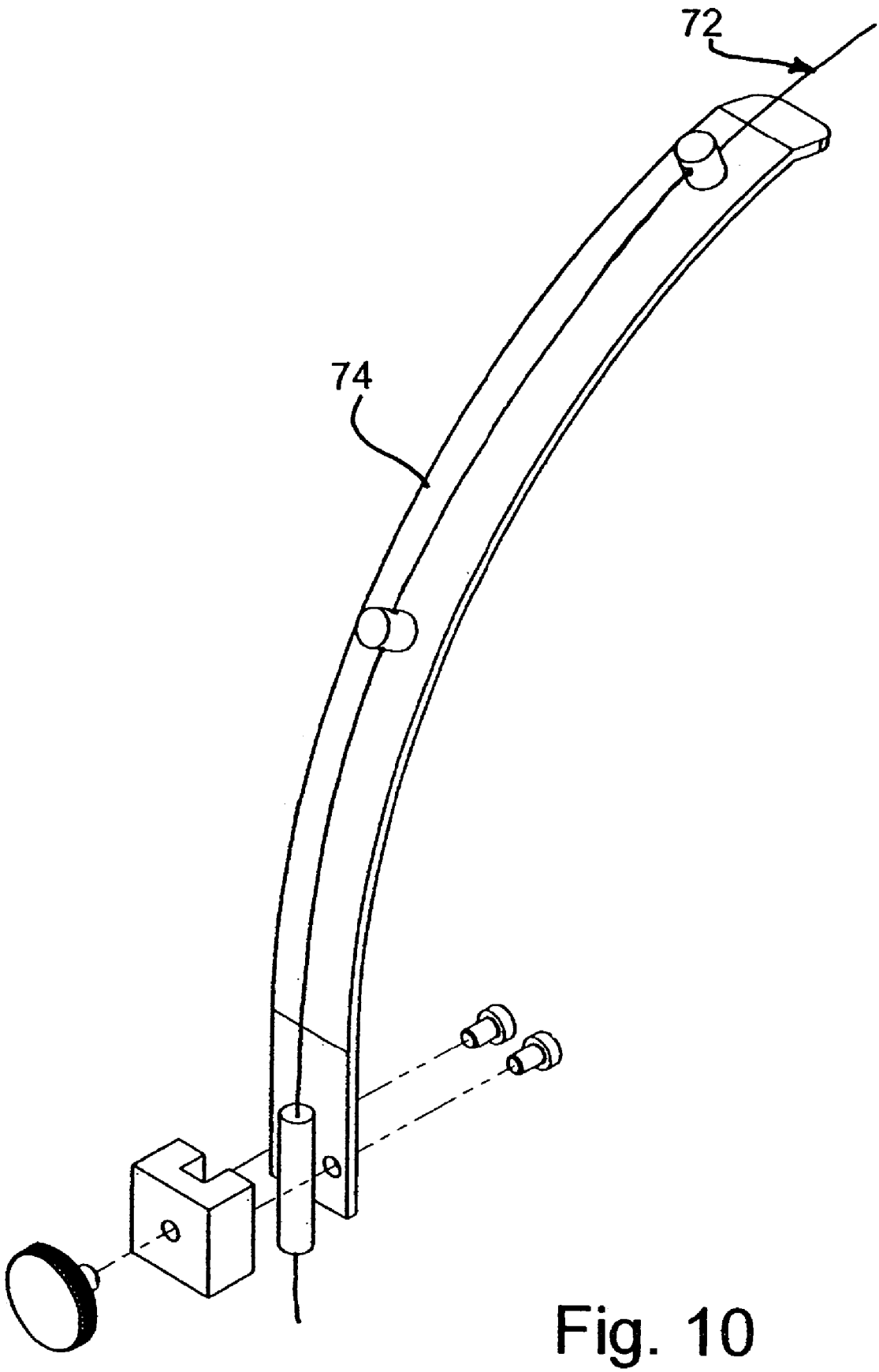
FIG. 10 is an exploded view of the wire inlet guide which delivers a continuous length of wire to wire advancing drive shown in FIG. 8.

Referring now to FIG. 9, on either side of advancement drums 82*a*, 82*b* are guide plates 80*a*, 80*b*. Guide plates 80*a, b* are provided with beveled guide voids 92 which permit self threading of wire 72 into plate 80*a* and out of beveled guide voids 92 on plate 80*a* to thereby position the wire to move across advancement drums 82*a, b* and into beveled guide voids 92 on plate 80*b*. The configuration of these beveled guides on plates 80*a, b* allows the wire to move across advancement drums 82*a, b* during loading of the wire and be captured in the opposed guide plate 80*b* without operator intervention or with only minimal operator intervention.

Figure 11:
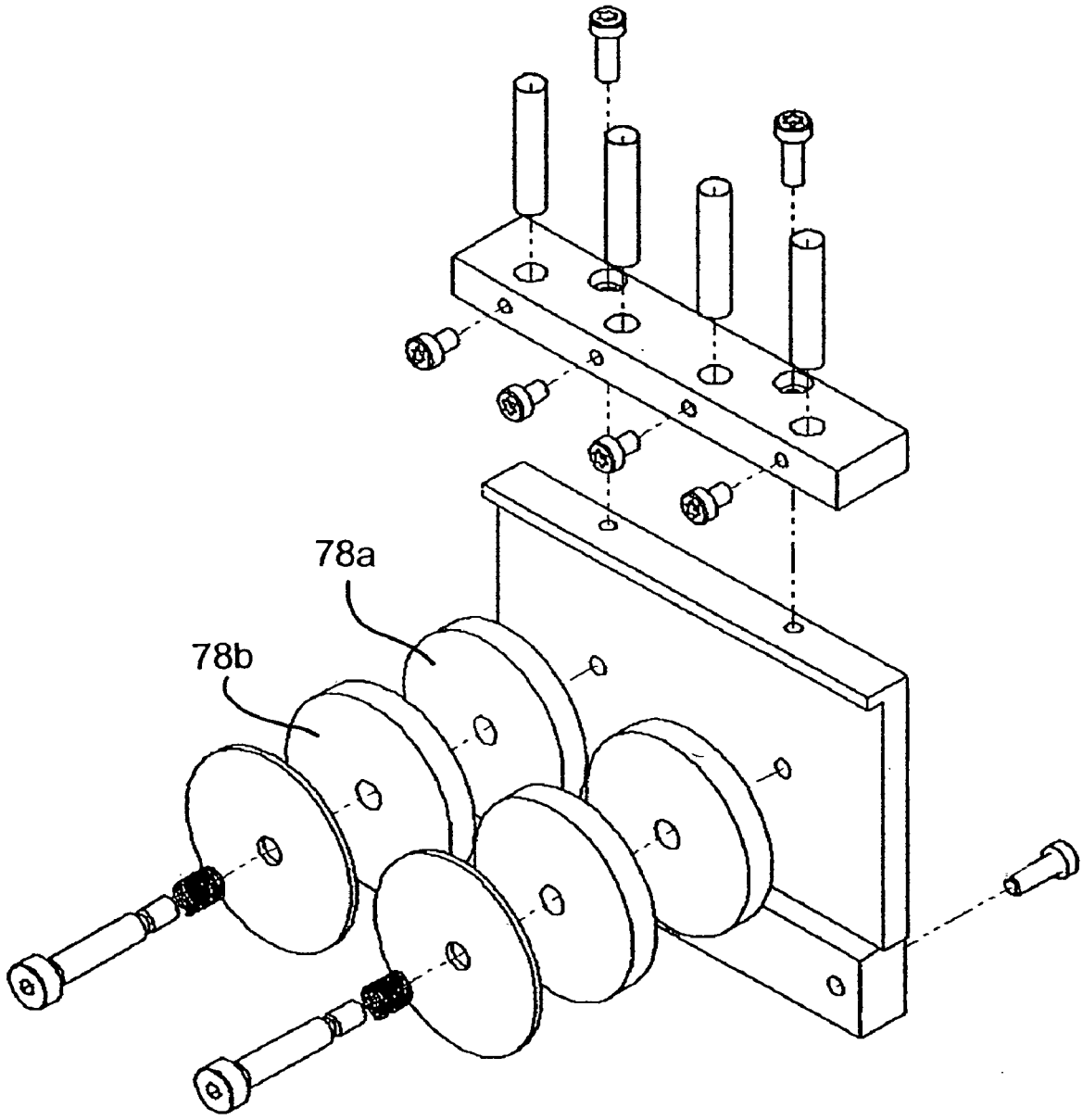
FIG. 11 shows the incoming wire alignment tubes and wire cleaning pads disposed therebelow for cleaning of the incoming strand of wire.
Figure 12:
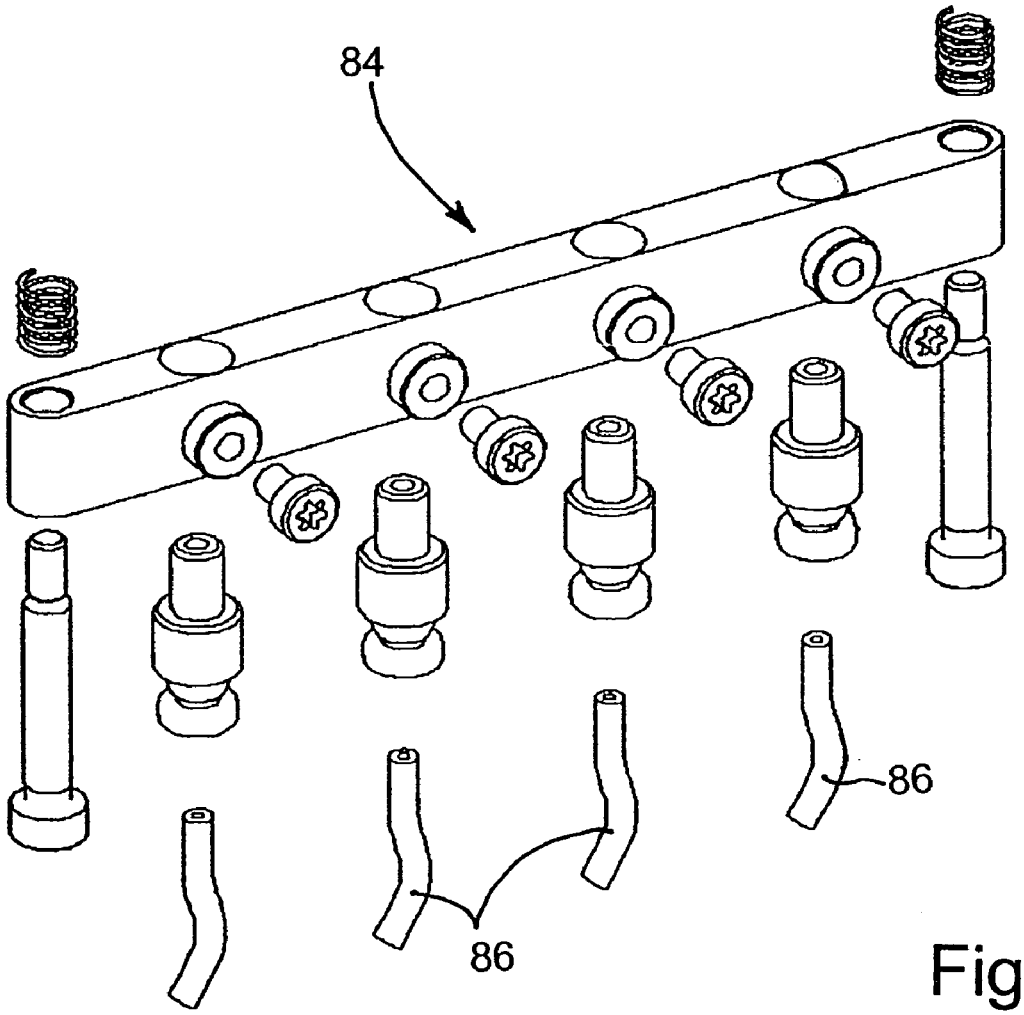
FIG. 12 shows the wire alignment device for guiding the wire as it exits from the wire advancing drive of FIG. 8 and which is spring mounted and distendable from the lower guide plate of wire advancing drive to permit ease of initial threading of new wire through the wire advancing drive.

Referring now to FIG. 11, it will be appreciated that prior to the wire entering the previously described advancement mechanism containing advancement drums 82*a, b* that the wire is cleaned by passing the wire across cleaning pads 78. In FIG. 11, is shown an exploded view of the cleaning pads 78 as mounted on the device is shown and the wire passes between pads 78*a* and 78*b* and is cleaned by the frictional contact between the wire and the pads. Once the wire has been advanced by the rotation of the wire advancement drums 82*a, b* the wire passes out of plate 80*b* and into exit guide 84 for insertion of the wire into tubes 86 which lead the wire to cutter boxes 20. Exit guide 84 is spring biased against plate 80*b* to allow a separation to be caused between exit guide 84 and guide plate 80*b* as the wire is loaded.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive oral fluid collection device is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

The invention claimed is:

1. A staple-forming and inserting apparatus comprising:

two or more staple-forming and inserting apparatus bodies spaced apart in side-by-side relationship, a wire cutter box mounted on each of said apparatus bodies each cutter box having an adjusting wheel mounted thereon, each of said adjusting wheels having a central threaded void for movably mounting said cutter box on a threaded pin extending from said apparatus body, said adjusting wheels each having outwardly extending gear teeth along the circumference of said adjusting wheel, and a cutter box adjuster comprising a spline gear for engagement with each of said adjusting wheels gear teeth to rotate each of said adjusting wheels for movement of said cutter box on said pin.

2. The apparatus as claimed in claim 1 wherein said spline gear is a shaft of sufficient length to engage each of said adjusting wheels on said two or more apparatus bodies.

3. A staple-forming and inserting apparatus comprising:

a staple bender rail, a staple-forming and inserting apparatus body having a channel for receiving said bender rail therein for slidable movement relative to said apparatus body of said bender rail in said channel, a plurality of removable key tracks mounted in said channel to contact and guide the slidable movement of said bender rail during slidable movement along said plurality of key tracks, and a spring washer for mounting said bender rail to permit outward movement of said bender rail from said apparatus body to reduce contact pressure between a first cutter blade and a second cutter blade mounted in said apparatus.

* * * * *